US008893807B2

(12) United States Patent
Tait

(10) Patent No.: US 8,893,807 B2
(45) Date of Patent: Nov. 25, 2014

(54) REMOTE SUBTERRANEAN TOOL ACTIVATION SYSTEM

(75) Inventor: Alasdair R. Tait, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 759 days.

(21) Appl. No.: 13/048,075

(22) Filed: Mar. 15, 2011

(65) Prior Publication Data

US 2012/0234530 A1 Sep. 20, 2012

(51) Int. Cl.

| | |
|---|---|
| ***E21B 23/01*** | (2006.01) |
| ***E21B 41/00*** | (2006.01) |
| ***E21B 23/00*** | (2006.01) |

(52) U.S. Cl.

CPC ..... *E21B 41/00* (2013.01); *E21B 23/00* (2013.01)

USPC ..... 166/382; 166/66.5; 166/214; 166/208; 166/215; 166/217; 166/72

(58) Field of Classification Search

CPC ..... E21B 23/00; E21B 41/00

USPC ..... 166/66.5, 208, 214, 215, 217, 382, 72

See application file for complete search history.

(56) References Cited

U.S. PATENT DOCUMENTS

| | | | | |
|---|---|---|---|---|
| 3,264,994 | A | 8/1966 | Leutwyler | |
| 3,933,202 | A | 1/1976 | Ahlstone | |
| 3,986,729 | A | 10/1976 | Taylor | |
| RE30,988 | E | 7/1982 | Crickmer | |
| 6,032,734 | A * | 3/2000 | Telfer | 166/66.5 |
| 6,926,089 | B2 | 8/2005 | Goodson et al. | |
| 7,413,028 | B2 | 8/2008 | Comarmond | |
| 7,562,712 | B2 | 7/2009 | Cho et al. | |
| 7,604,061 | B2 | 10/2009 | Fay et al. | |
| 7,624,797 | B2 * | 12/2009 | Fay | 166/215 |
| 7,626,393 | B2 | 12/2009 | De Jesus et al. | |
| 7,669,663 | B1 | 3/2010 | Hall et al. | |
| 7,703,532 | B2 | 4/2010 | O'Malley et al. | |
| 7,828,066 | B2 | 11/2010 | Jahn | |
| 2009/0032238 | A1 | 2/2009 | Rogers et al. | |
| 2009/0044944 | A1 | 2/2009 | Murray et al. | |
| 2010/0126716 | A1 | 5/2010 | Joseph | |

* cited by examiner

*Primary Examiner* — Jennifer H Gay

*Assistant Examiner* — George Gray

(74) *Attorney, Agent, or Firm* — Steve Rosenblatt

(57) ABSTRACT

An actuation tool uses a lock that when released allows a moving magnet to move into position to repel another magnet. The repelling force on the second magnet moves it away from a locking position on a stored potential energy system where the release of the potential energy creates kinetic energy to drive an actuation assembly to set the tool. In a preferred application the tool can be a liner hanger. The release device can be a selectively energized electromagnet or a solenoid that shifts at least one magnet into alignment with at least one second magnet so as to defeat the second magnet from effectively storing the potential energy that can set the tool when the lock is defeated.

22 Claims, 10 Drawing Sheets

REMOTE SUBTERRANEAN TOOL ACTIVATION SYSTEM

FIELD OF THE INVENTION

The field of the invention is actuation devices for subterranean tools and more particularly devices that enable selective remote actuation while avoiding wall openings and their associated seals that can present potential leak paths. The device will allow actuation of equipment without a need to have any plug in the tubing against which pressure has to be applied.

BACKGROUND OF THE INVENTION

Pressure actuated assemblies that are designed to selectively actuate a subterranean tool typically involves a ball seat and a ball that is dropped or pumped to the ball seat and landed. Once the ball is landed internal pressure is built up through a wall opening to a piston housing surrounding the main bore so that a tool can be actuated. Typically a piston receives the internal pressure through a wall port and has an opposite end referenced to annulus pressure. Raising the tubing pressure moves the piston which actuates the tool. In one example of a liner hanger, the piston can move slips and a sealing element to support a liner from a surrounding casing.

There can be issues with such a design. The tool can be in a long horizontal run so that it may take the ball a long time to get to the seat without having to be pumped. In a horizontal run the ball may not locate on the seat even with a flowing stream urging the ball to the seat. Wall openings to piston housings can also present potential leak paths if seals deteriorate or fail.

Accordingly, an actuation system is needed that can be selectively operated from a remote location to operate a tool at the desired location. In the preferred embodiment an actuation system is described that locks in potential energy with a lock that is disabled to release the potential energy to set the tool. In a preferred application a liner hanger slip system and seal can be set with the device. The lock is defeated with physical movement that is induced with an applied field or with an electromechanical device to name a few preferred options. In one embodiment the field is magnetic and the lock release is accomplished with a repelling response to a magnet that serves at least in part as a locking key and whose movement results in a release of the potential energy force. Those skilled in the art will better appreciate aspects of the preferred embodiments of the invention from a review of the description of the preferred embodiment and the associated FIGS. while recognizing that the full scope of the invention is to be found in the appended claims.

U.S. Pat. No. 7,703,532 illustrates moving a magnet in position to hold open a flapper in a safety valve in the open position and to reduce its tendency to chatter in the open position. US Publication 2009/0032238 illustrates a magnet used to assist the movement of a flapper in a safety valve to go to an open position by adding to the gravity force of the flapper weight that tends to move it to the open position. Another magnet can be used to urge the flapper to the closed position. U.S. Pat. No. 7,828,066 transmits power through a magnetic shaft coupling. U.S. Pat. No. 3,264,994 shows the use of a magnet on a dart that is pumped past a tool to use the field to trigger tool actuation. US Publication 2010/0126716 illustrates a hard wired system for initiating tool actuation using a magnetic field. Other patents of interest with regard to the present invention are: U.S. Pat. Nos. RE 30,988; 7,703,532; 7,669,663; 7,562,712; 7,604,061; 7,626,393 and 7,413,028.

SUMMARY OF THE INVENTION

An actuation tool uses a lock that when released allows a moving magnet to move into position to repel another magnet. Alternatively a magnetic field can be triggered in a stationary magnet such as one delivered on wireline, for example, to accomplish tool actuation. The repelling force on the second magnet moves it away from a locking position on a stored potential energy system where the release of the potential energy creates kinetic energy to drive an actuation assembly to set the tool. In a preferred application the tool can be a liner hanger. The release device can be a selectively energized electromagnet or a solenoid that shifts at least one magnet into alignment with at least one second magnet so as to defeat the second magnet from effectively storing the potential energy that can set the tool when the lock is defeated.

DETAILED DESCRIPTION OF THE PREFERRED EMBODIMENT

Figure 4:
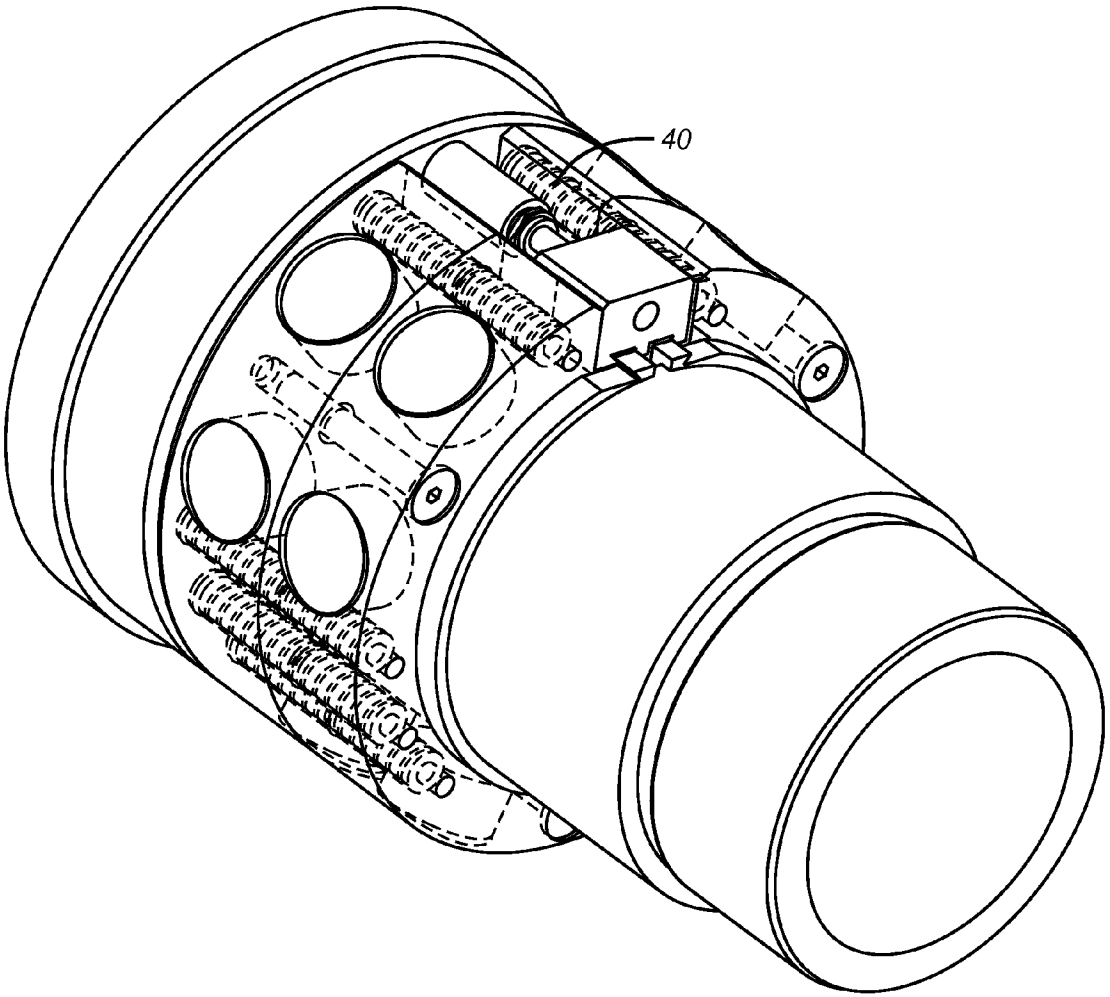
FIG. 4 is a perspective view of the FIG. 3 position just before the springs push the tandem rings to reposition the magnets in those rings.
Figure 5:
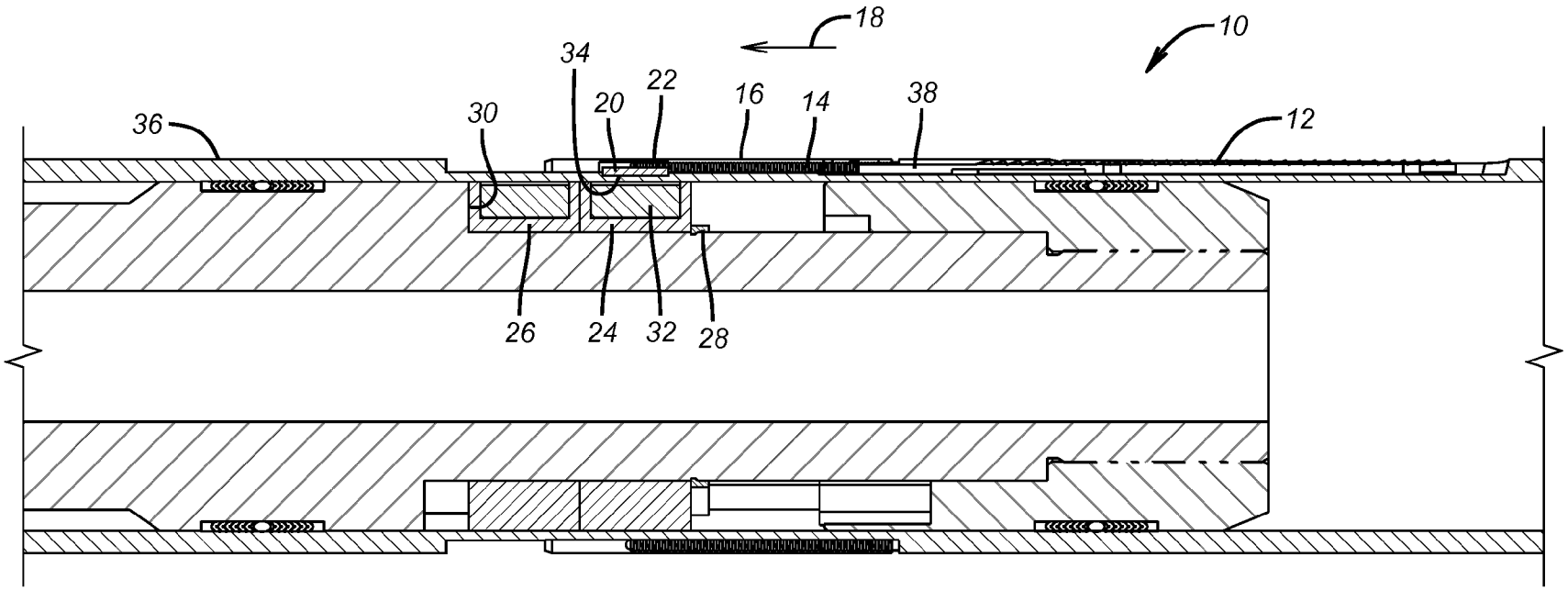
FIG. 5 is a section view of a liner hanger in the run in position showing the tandem rings holding locking segments in a locked position to prevent the slips from setting.
Figure 6:
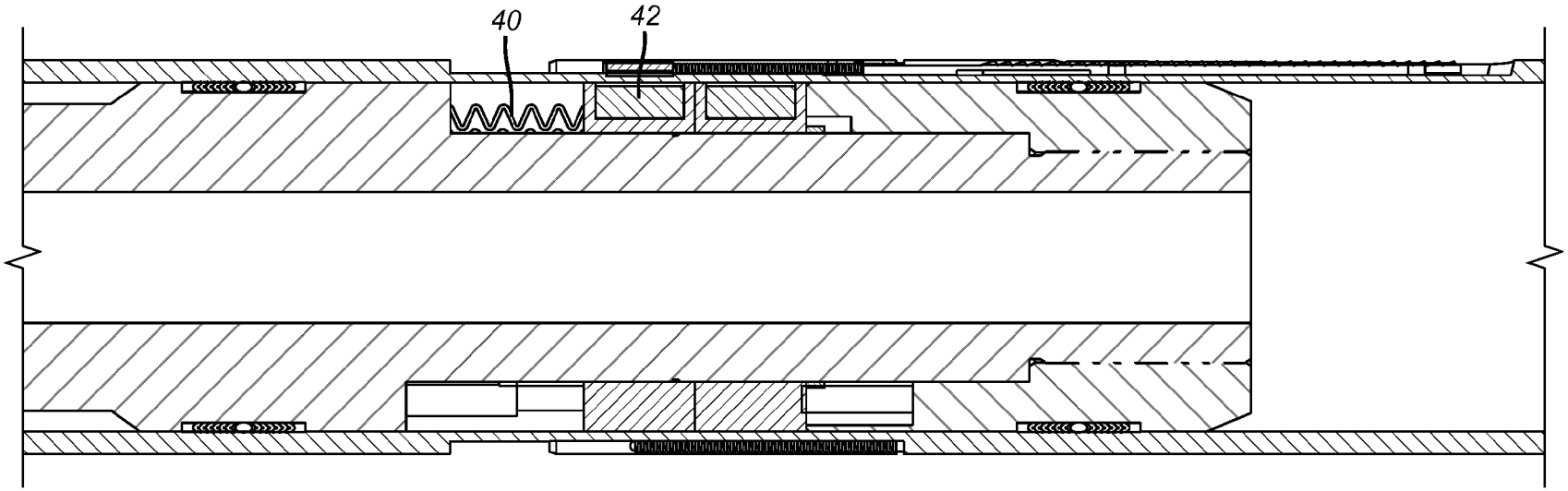
FIG. 6 is the view of FIG. 5 showing the tandem rings shifted and the locking segments repelled so that the setting spring for the slips can move the slips.
Figure 7:
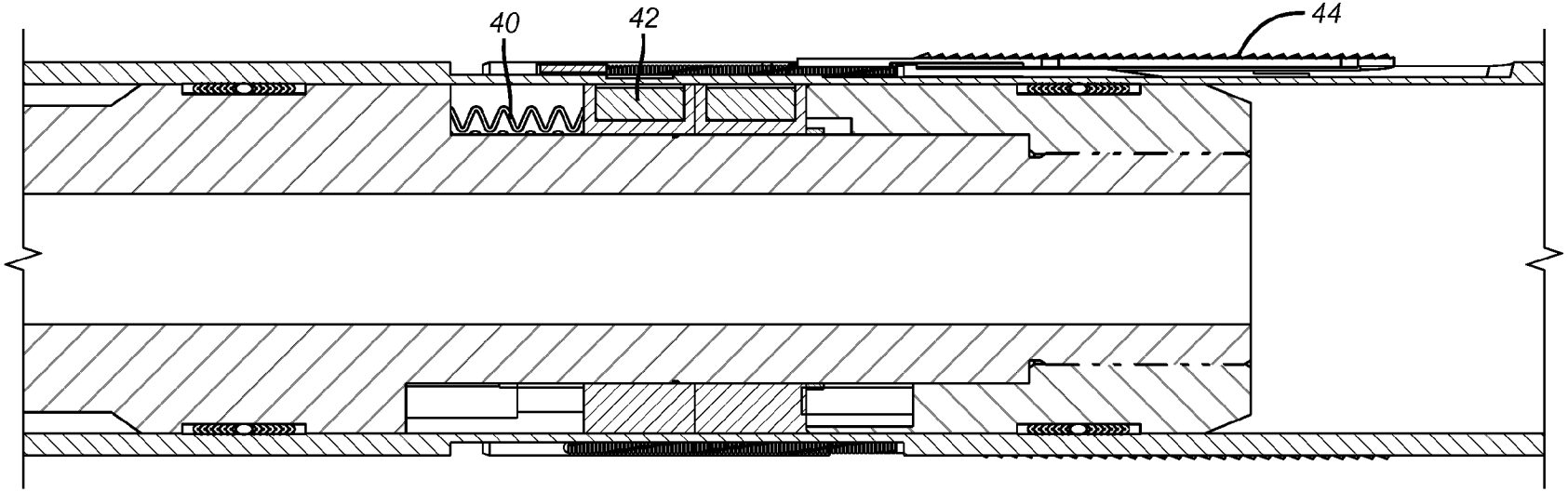
FIG. 7 is the view of FIG. 6 with the slips fully activated for gripping a surrounding tubular.

FIGS. 1-4 are best understood in conjunction with FIGS. 5-7. FIGS. 5-7 illustrate an example of an application of the actuation system in the form of a liner hanger 10 that has, in one embodiment, a ring of segments 12 that axially translate with respect to each other to increase in diameter as better seen in FIGS. 10 and 11. The drawings are schematic and are intended to illustrate that the slips 12 in whatever way they are assembled are axially translated in tandem or relative to each other depending on the design by the force of spring 14 acting on setting sleeve 16 to push it in the direction of arrow 18. One or more lock segments 20 are initially disposed in matching grooves 22 to prevent motion in the direction of arrow 18 by the setting sleeve 16. Lower magnet ring 24 and upper magnet ring 26 are retained by snap ring 28 against shoulder 30 in a position where magnets 32 attract the lock segments 20 such that segments 20 are partly into groove 22 and partly into a recess 34 in the housing 36. Instead of using magnet ring 24 a retainer that is overcome when ring 26 moves into position can be used as an alternative arrangement to retain the initial locked position. Snap ring 28 is a primary lock while segments 20 are considered the secondary lock that is actuated as a result of release of the primary lock or snap ring 28 in the preferred embodiment. Setting Sleeve 16 contains T-slots into which the segment ring 12 interlocks. Spring 14 cannot move the sleeve 16 as long as the lock segments 20 straddle grooves 22 and recesses 34. The attraction from magnets 32 acting on lock segments 20 retains the segments 20 in the FIG. 5 position where the grooves 22 and the recesses 34 are straddled to hold the springs 14 in the compressed position.

Figure 10:
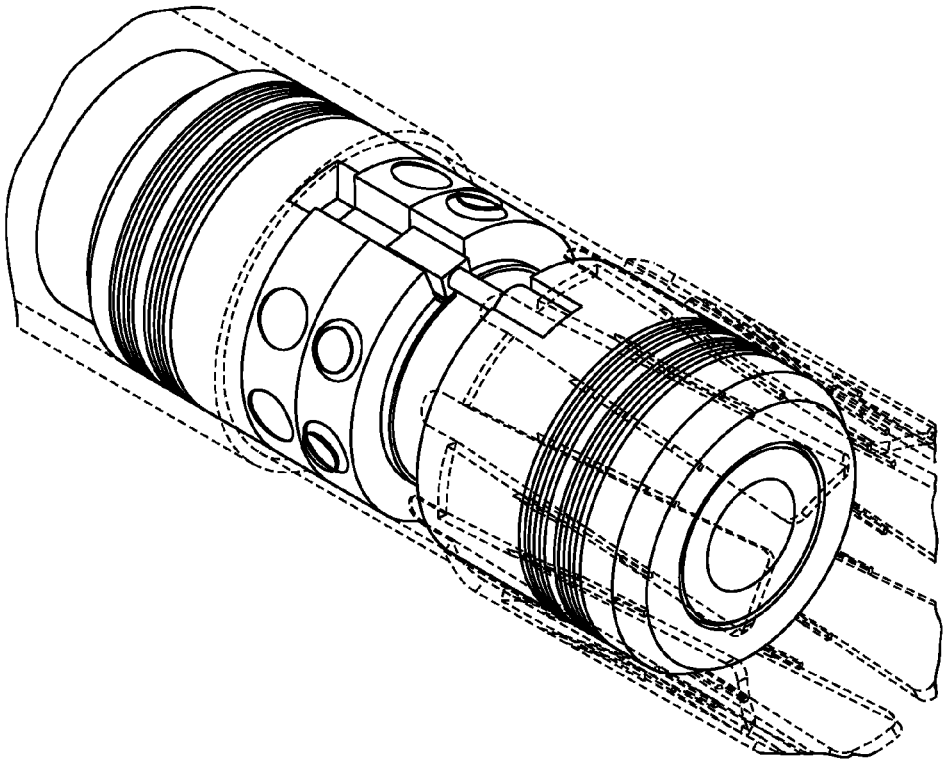
FIG. 10 is a perspective view for run in of a liner hanger using the mechanism of FIG. 8.
Figure 11:
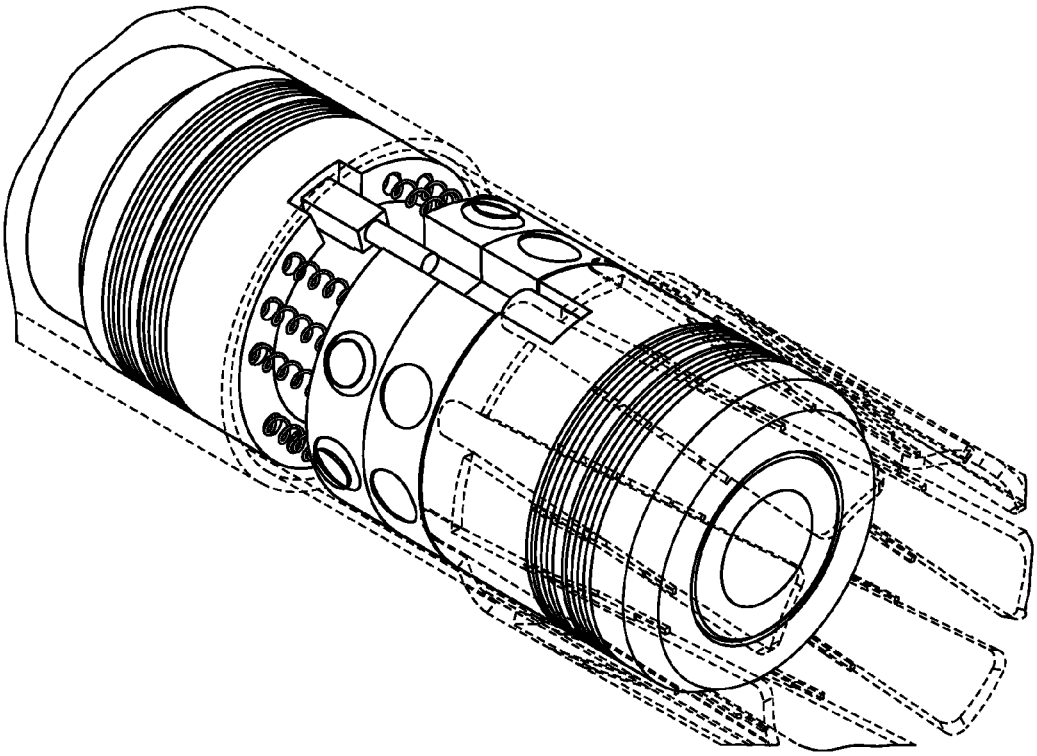
FIG. 11 is the view of FIG. 10 in the set position.

Actuation involves a release of the snap ring 28 that in turn allows the springs 40 to axially move rings 24 and 26 so that magnets 42 now align with segments 20. Alternatively the magnets 32 and 42 can be on a single ring that can rotate instead of translating to change the polarity of the magnet facing the segments 20. The magnets 42 have an opposite pole facing the segments 20 such that the segments 20 are now radially outwardly repelled to move out of recess 34 and fully into groove 22. The sleeve 16 is now free to move in the direction of arrow 18 so that the slips 12 can move out radially to engage a surrounding tubular either by riding up a taper or as shown in FIGS. 10 and 11 by relative axial movement of tapered segments that have wickers 44 as shown in FIGS. 5-7, for example.

Figure 1:
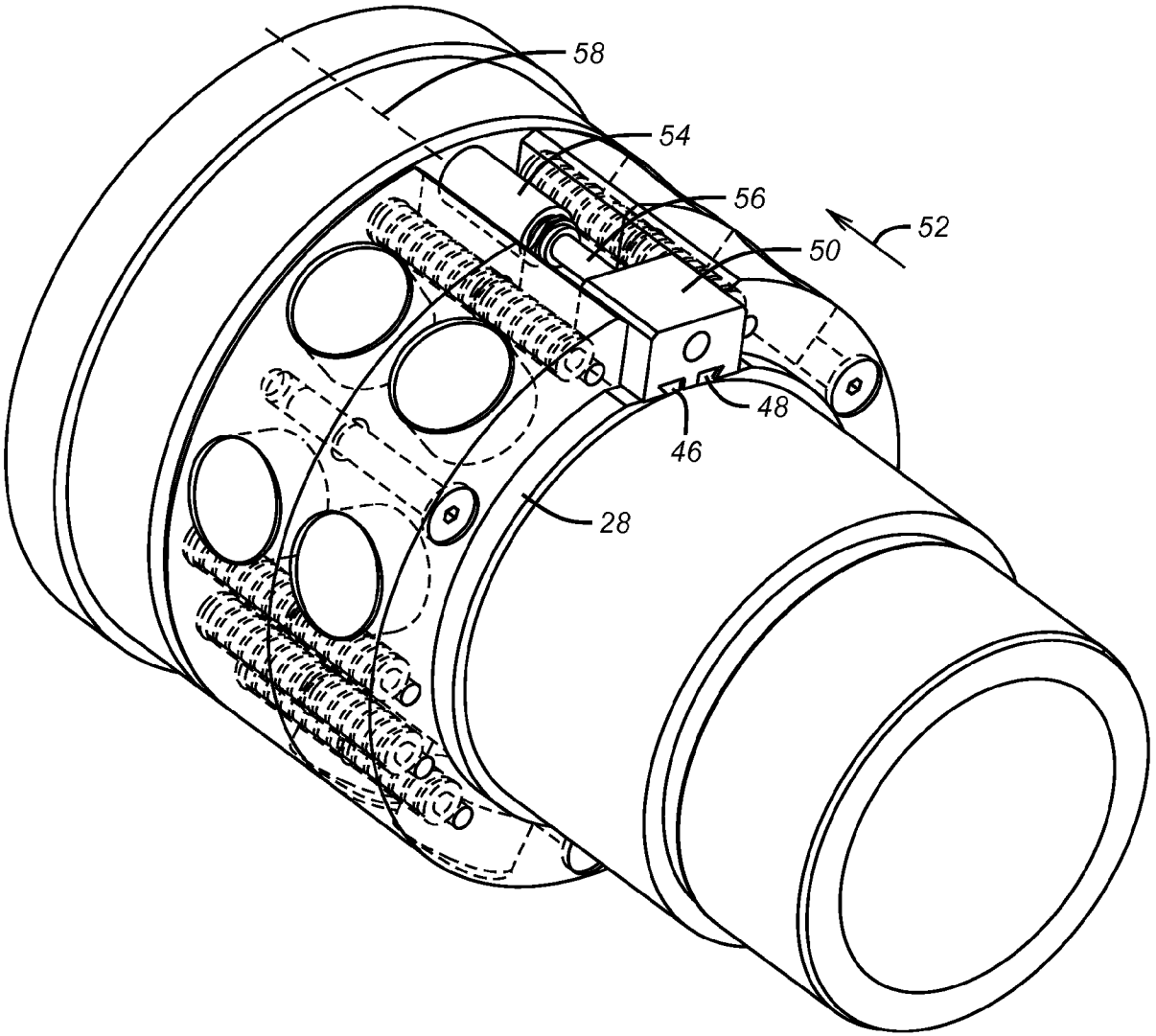
FIG. 1 is a perspective view of the trigger mechanism for the lock shown in the run in position and in perspective.
Figure 2:
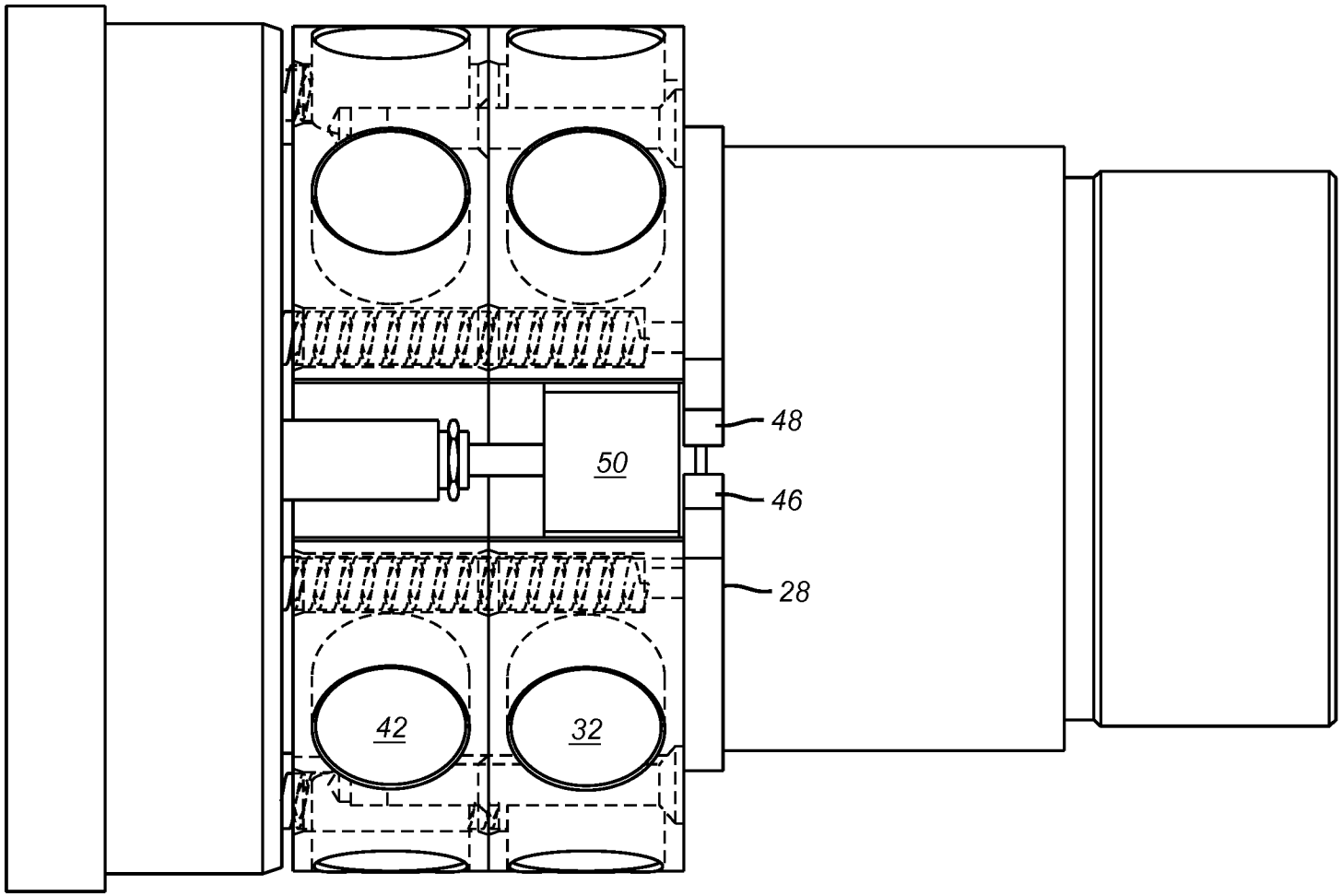
FIG. 2 is a side view of FIG. 1 showing the retainer for the snap ring retracted by a solenoid.
Figure 3:
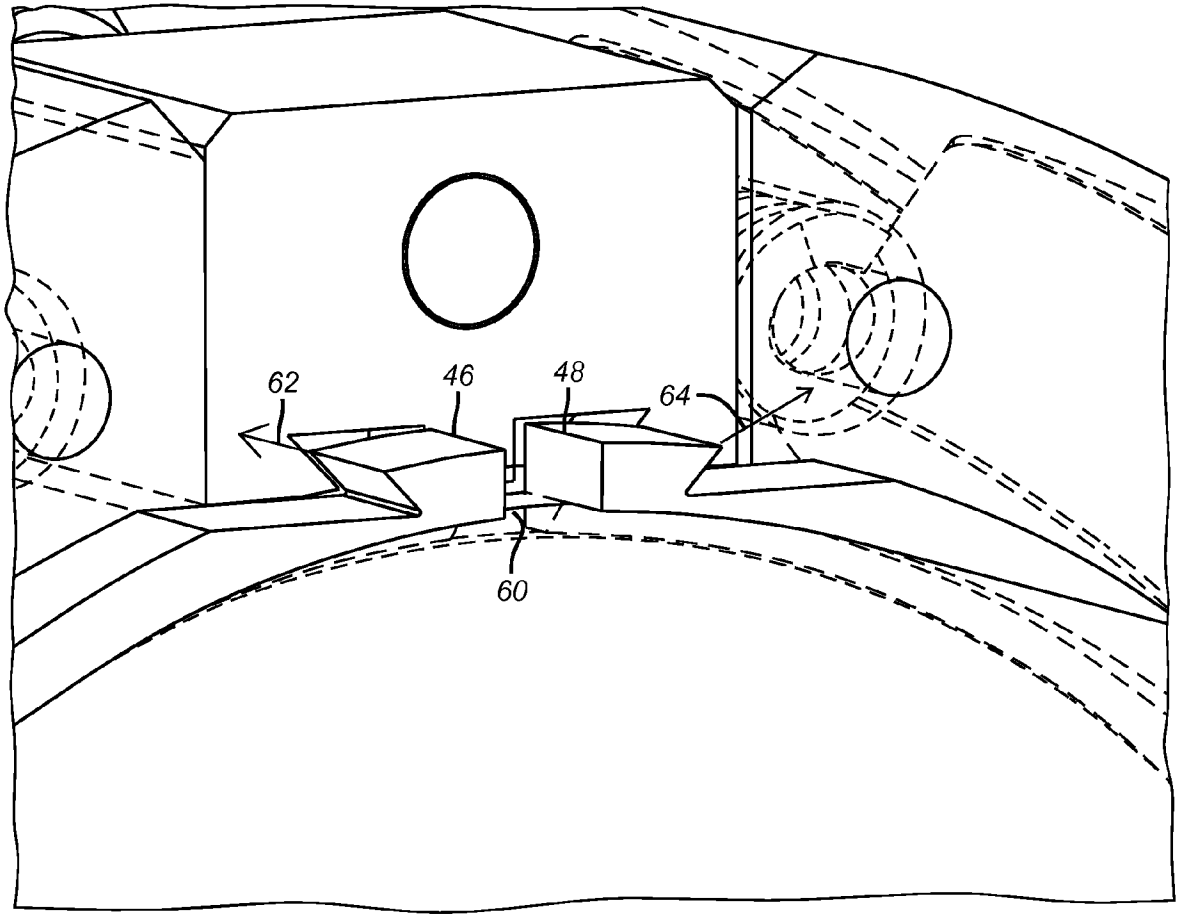
FIG. 3 is an alternative view of the FIG. 2 position showing the snap ring in perspective and a portion of the snap ring that extends into a circular groove to allow the snap ring to function as a travel stop.

FIGS. 1-4 show in more detail how the snap ring 28 is released. Snap ring 28 has shaped ends 46 and 48 that are retained by similarly shaped grooves in block 50. Block 50 is selectively actuated from a surface location to move in the direction of arrow 52 by a solenoid valve assembly 54 that has an axially movable shaft 56 that moves in the direction of arrow 52 when power that is schematically represented by dashed line 58 is supplied to coil in the assembly 54. FIG. 2 shows the block 50 retracted in the direction of arrow 52 and the ends 46 and 48 no longer retained by block 50. The stored potential energy in the ring 28 allows it to snap out of its associated groove 60 best seen in FIG. 3 as the ends 46 and 48 move respectively in the direction of arrows 62 and 64. At this point the springs 40 are able to push the rings 24 and 26 in tandem so that the segments 20 can then be radially outwardly repelled to allow the force stored in the spring 14 to move the sleeve 16 and cause the wickers 44 to bite into a surrounding tubular that is not shown. FIG. 4 shows the components just in the instant before the springs 40 move the rings and FIG. 7 is a section view after that movement has happened showing the wickers 44 in a set position against the surrounding tubular.

Figure 8:
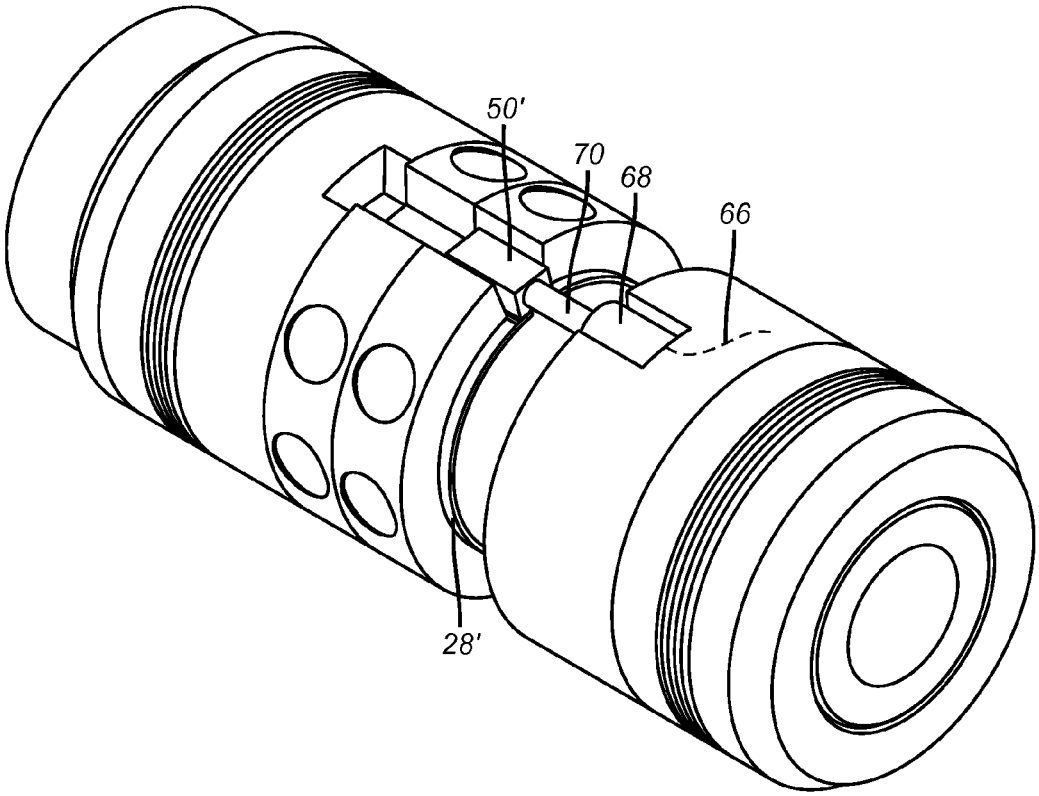
FIG. 8 is a perspective view of a run in position for an alternative mechanism to the FIG. 1 embodiment that actuates with an applied magnetic field.
Figure 9:
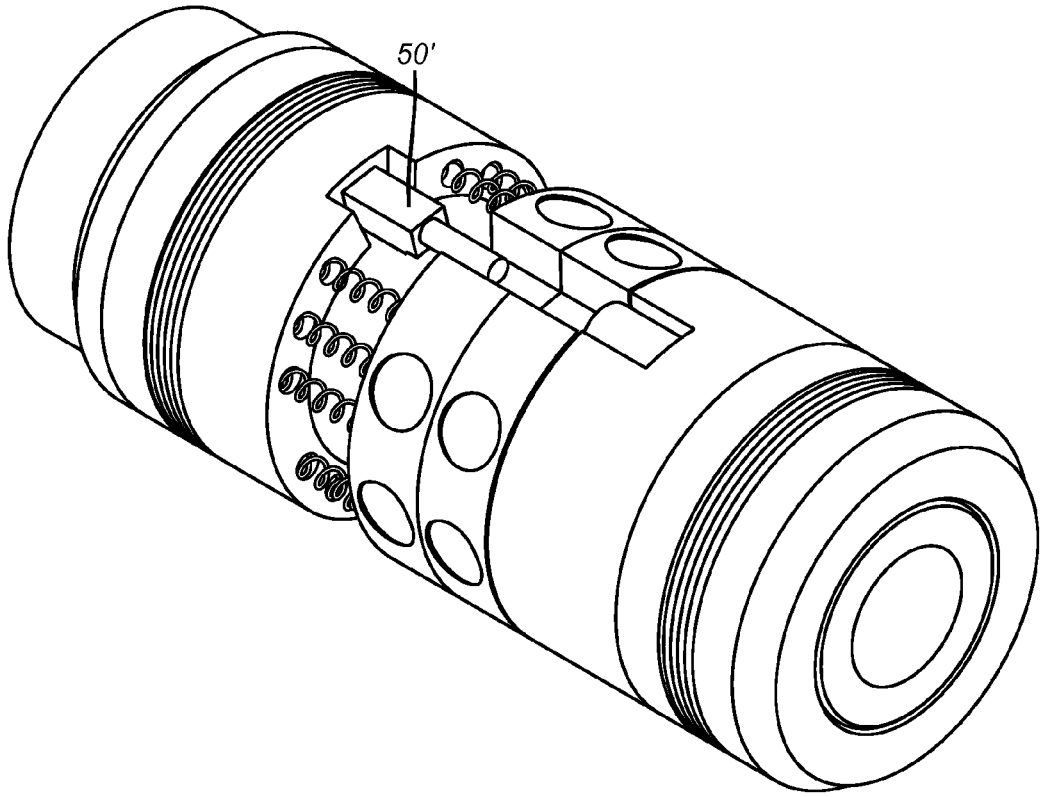
FIG. 9 is the view of FIG. 8 in the set position.

FIGS. 8 and 9 show another way to release the snap ring 28' by movement of the block 50'. In this embodiment a surface controlled power source shown schematically as dashed line 66 selectively energized an electromagnet 68 that when energized repels the permanent magnet 70 to displace the block 50' to the FIG. 11 position. As before when the snap ring 28 has ends 46 and 48 exposed, the rings 24 and 26 are able to move in tandem under the force of spring 40 and the setting proceeds as previously described.

Figure 12:
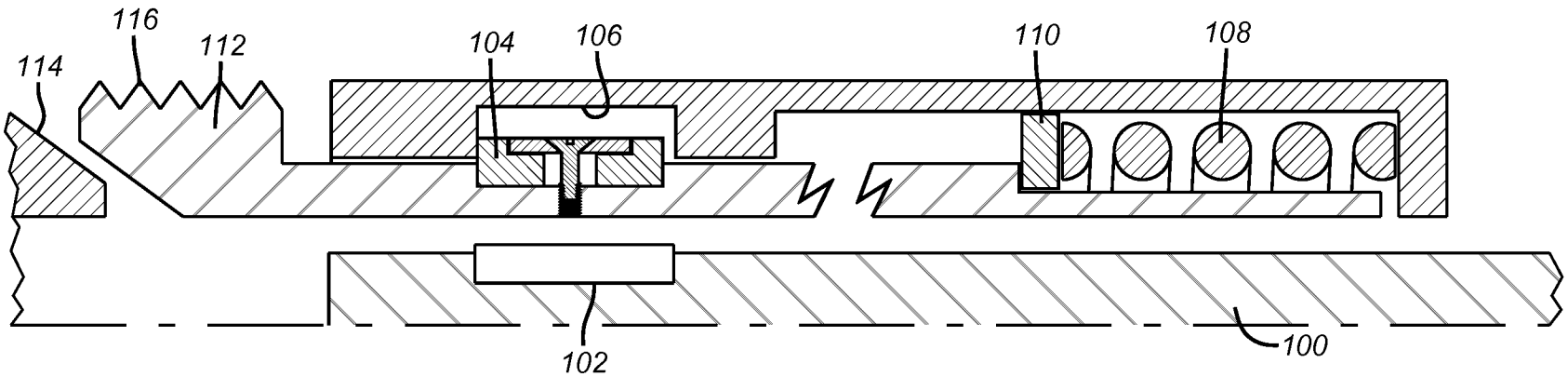
FIG. 12 is a section view of an alternative embodiment that uses a running tool to unlock the tool using an electro-magnetic field to repel the locking magnet.
Figure 14:
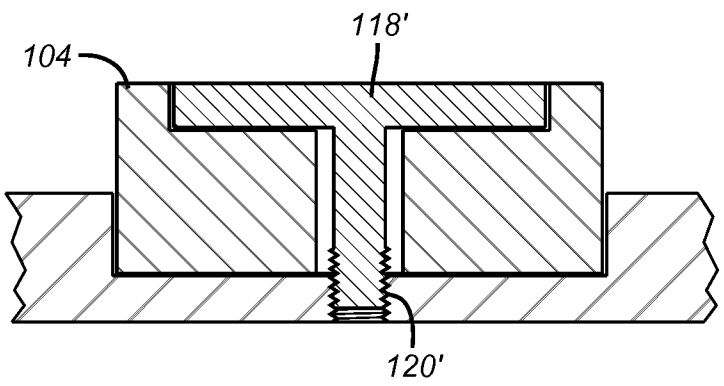
FIG. 14 is an alternative embodiment of the locking segment of FIG. 13.
Figure 13:
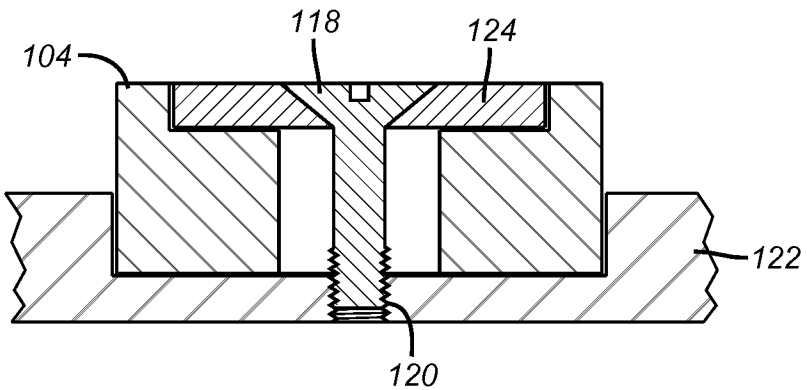
FIG. 13 is a detailed view of a locking segment that is repelled to shear a pin with the field presented from the running tool of FIG. 12.

FIGS. 12-14 use a running tool 100 that has an electromagnet 102 that is oriented as such that upon activation from a power source will provide an opposite pole at the outward facing surface from that of the inward facing surface of the magnet 104 to drive segment 104 radially outwardly into recess 106 so as to allow the spring 108 to push against stop 110 to allow slips 112 to climb ramp 114 to allow wickers 116 to bite the surrounding tubular. Set screw 118 holds the segment 104 to the housing 122 for run in via threads 120. With electro-magnet 102 activated, the repelling force is sufficient to shear out the shear plate 124 to get the segments 104 fully into the recess 106. In FIG. 13 a plate 124 has the screw 118 extending through it and secured to housing 122 by threads 120. In FIG. 14 the screw 118' integrates what is the plate 124 of FIG. 13 as part of the screw head again to secure the segment 104 at thread 120'.

Those skilled in the art will now appreciate that what is disclosed is a surface controlled system that can release a stored potential energy force to set a tool where dropping objects on seats and pressuring up through wall openings that present leak paths are not an issue. Instead a primary device such as a solenoid or an electromagnet to illustrate some examples is triggered to then allow movement of magnetic members to release a key to then liberate the stored potential energy force to create kinetic energy to set a tool.

While a liner hanger is used in the illustrations above, other types of well tools are also contemplated. Rings 24 and 26 while shown as two discrete rings with magnet inserts 32 and 42 that are in each ring with their polarity on the outward side being different, could also be a single ring or ring segments. The entirety of the rings 24 and 26 could be magnetic rings or segments. The lock segments 20 can be magnets themselves or they can simply be constructed of a magnetic material and can have a variety of shapes that are compatible with movement of segments 20 in recesses 34 or grooves 22. The lock segments may be a sub assembly of two components—one component will be of a mechanically strong material to ensure that the locking device can hold the stored load of springs 14 and form the shape of a cap to surround the magnetic material. The second part will be the magnetic component which will act as previously described to force the cap out of recess 34 and allow the tool to set without requiring mechanical properties from the magnetic component when being run in hole. While a coil spring 40 is illustrated the movement of the rings 24 and 26 can be accomplished with equivalent devices that store potential energy such as a volume of compressed gas or a stack of Belleville washers as some examples. While the embodiments show removing support for a snap ring 28 other alternatives that allow movement of the rings 24 and 26 can be used such as a shear ring that is snapped by a driving mechanism that gets the same motion accomplished as assembly 54. Using a member that fails in shear will require more applied force than the illustrated embodiments that translate a block and expose ends 46 and 48 of a snap ring 28. The attracting magnet 32 in the running tool may be removed and as such the locking segments 20 may be retained in recess 34 by another means—such as an overlaying leaf spring—until the repelling force is applied. The repelling force will always be strong enough to repel the locking segments 20 as well as overcoming any forces that are present in order to hold the locking segment 20 in place.

The above description is illustrative of the preferred embodiment and many modifications may be made by those skilled in the art without departing from the invention whose scope is to be determined from the literal and equivalent scope of the claims below.

I claim:

1. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a primary lock whose defeat with axial movement of a mechanically moved retainer allows said assembly to move relatively to said potential energy source;

said assembly comprises a source for at least one magnetic field, said source moving after said retainer axial movement.

2. The apparatus of claim 1, wherein:

said assembly moves axially without contact of said selectively locked potential energy source as said assembly unlocks said potential energy source.

3. The apparatus of claim 2, wherein:

said potential energy source is selectively retained by a secondary lock;

said secondary lock responsive to a magnetic field for unlocking.

4. The apparatus of claim 3, wherein:

said source for the magnetic field acts on said secondary lock in both a first and a second position of said assembly.

5. The apparatus of claim 4, wherein:

said source for said magnetic field attracts said secondary lock in said first position and repels said secondary lock in said second position or said secondary lock is retained in said first position with a retainer that is overcome when said second position of said secondary lock is attained.

6. The apparatus of claim 5, wherein:

said source comprises at least one first magnet with an outer face being a north pole and at least one second magnet with an outer face being a south pole, said magnets aligned with each other on at least one ring whereby movement of said ring aligns a different magnet with said secondary lock.

7. The apparatus of claim 6, wherein:

said ring translates when said primary lock is defeated.

8. The apparatus of claim 1, wherein:

said assembly is mounted to a running tool inserted into a passage through said housing.

9. The apparatus of claim 8, wherein:

said assembly comprises a magnet that repels at least one segment initially in a housing groove out of said housing groove to allow said potential energy source to relatively move an outer housing located about said housing and thereby set the tool.

10. The apparatus of claim 9, wherein:

said segment is secured with a fastener to said housing groove and said magnet on said running tool when brought into proximity to said segment applies a repelling force to said segment sufficient to shear said fastener and then move said segment out of said housing groove so that said outer housing moves axially to set the tool.

11. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a primary lock whose defeat allows said assembly to move relatively to said potential energy source;

said assembly moves axially without contact of said selectively locked potential energy source as said assembly unlocks said potential energy source;

said potential energy source is selectively retained by a secondary lock;

said secondary lock responsive to a magnetic field for unlocking;

said assembly comprises a source for at least one magnetic field;

said source for the magnetic field acts on said secondary lock in both a first and a second position of said assembly;

said source for said magnetic field attracts said secondary lock in said first position and repels said secondary lock in said second position or said secondary lock is retained in said first position with a retainer that is overcome when said second position of said secondary lock is attained;

said secondary lock comprises at least one segment that straddles opposed recesses on said housing and on an outer housing;

said potential energy source disposed between said housing and said outer housing and prevented from moving said outer housing relative to said housing when said segment straddles said recesses.

12. The apparatus of claim 11, wherein:

repelling said segment moves said segment out of said recess in said housing to allow said potential energy source to move said outer housing relative to said housing to set the tool.

13. The apparatus of claim 12, wherein:

said outer housing comprises a portion of a liner hanger and movement of said outer housing extends at least one slip to grip a surrounding tubular;

said potential energy source comprises at least one of a coil spring, a compressed gas reservoir and a Belleville washer stack.

14. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a potential energy retaining primary lock whose defeat by release of said potential energy associated with said primary lock allows a secondary lock on said assembly to be defeated by radial movement of at least one locking dog made possible by said defeat of said primary lock;

said primary lock comprises a snap ring held to a housing groove by a retainer that selectively retains opposed ends of said snap ring.

15. The apparatus of claim 14, wherein:

said retainer is shifted in response to a signal from the remote location to release said ends of said snap ring that allows said snap ring to come out of the housing groove.

16. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a primary lock whose defeat allows said assembly to move relatively to said potential energy source;

said primary lock comprises a snap ring held to a housing groove by a retainer that selectively retains opposed ends of said snap ring;

said retainer is shifted in response to a signal from the remote location to release said ends of said snap ring that allows said snap ring to come out of the housing groove;

said retainer is shifted by one of a solenoid valve member and a magnetic field energized from the remote location.

17. The apparatus of claim 16, wherein:

said retainer comprises a magnet and said housing comprises an adjacent electromagnet, whereupon actuation of said electromagnet creates a magnetic field that affects movement of said magnet on said retainer.

18. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a primary lock whose defeat allows said assembly to move relatively to said potential energy source;

said primary lock comprises a snap ring held to a housing groove by a retainer that selectively retains opposed ends of said snap ring;

said retainer is shifted in response to a signal from the remote location to release said ends of said snap ring that allows said snap ring to come out of the housing groove;

said assembly comprises at least one first magnet with an outer face being a north pole and at least one second magnet with an outer face being a south pole, said magnets aligned with each other on at least one ring whereby movement of said ring aligns a different magnet with said secondary lock.

19. The apparatus of claim 18, wherein:

said secondary lock comprises at least one segment that straddles opposed recesses on said housing and on an outer housing;

said potential energy source disposed between said housing and said outer housing and prevented from moving said outer housing relative to said housing when said segment straddles said recesses.

20. The apparatus of claim 19, wherein:

repelling said segment moves said segment out of said recess in said housing to allow said potential energy source to move said outer housing relative to said housing to set the tool.

21. The apparatus of claim 20, wherein:

said outer housing comprises a portion of a liner hanger and movement of said outer housing extends at least one slip to grip a surrounding tubular;

said potential energy source comprises at least one of a coil spring, a compressed gas reservoir and a Belleville washer stack.

22. An actuation apparatus for a subterranean tool selectively operable from a remote location, comprising:

a housing further comprising a selectively locked source of potential energy whose release operates the tool;

an assembly associated with said housing and selectively actuated from the remote location, whereby actuation of said assembly creates movement which unlocks said source of potential energy for setting the tool;

said assembly comprises a primary lock whose defeat allows said assembly to move relatively to said potential energy source;

said assembly moves axially without contact of said selectively locked potential energy source as said assembly unlocks said potential energy source;

said potential energy source is selectively retained by a secondary lock;

said secondary lock responsive to a magnetic field for unlocking;

said assembly comprises a source for at least one magnetic field;

said source for the magnetic field acts on said secondary lock in both a first and a second position of said assembly;

said source for said magnetic field attracts said secondary lock in said first position and repels said secondary lock in said second position or said secondary lock is retained in said first position with a retainer that is overcome when said second position of said secondary lock is attained;

said source comprises at least one first magnet with an outer face being of a first polarity on at least one ring whereby movement of said ring aligns said first magnet with a second magnet of opposite polarity on said secondary lock to defeat said secondary lock.

* * * * *